United States Patent [19]

Graham

[11] Patent Number: 4,849,768

[45] Date of Patent: Jul. 18, 1989

[54] PRINTING RANDOM PATTERNS WITH FLUID JETS

[75] Inventor: Louis A. Graham, Greensboro, N.C.

[73] Assignee: Burlington Industries, Inc., Greensboro, N.C.

[21] Appl. No.: 188,701

[22] Filed: May 4, 1988

Related U.S. Application Data

[60] Continuation of Ser. No. 26,488, Mar. 16, 1987, abandoned, Continuation-in-part of Ser. No. 908,289, Sep. 17, 1986, Division of Ser. No. 729,412, May 1, 1985, Pat. No. 4,650,694.

[51] Int. Cl.[4] ..... G01D 15/16

[52] U.S. Cl. ..... 346/1.1; 68/205 R; 118/315; 346/75; 427/280

[58] Field of Search ..... 346/1.1, 75; 427/262, 427/280, 256; 118/315; 68/205 R; 8/149; 101/426

[56] References Cited

U.S. PATENT DOCUMENTS

| | | | |
|---|---|---|---|
| 3,373,437 | 3/1968 | Sweet | 346/75 |
| 3,737,393 | 6/1973 | Lyon | 346/75 X |
| 3,969,779 | 7/1976 | Stewart | 68/205 R X |
| 4,032,978 | 6/1977 | Wong | 358/298 X |
| 4,234,214 | 11/1980 | Lee | 400/126 X |
| 4,287,522 | 9/1981 | Meyer | 346/75 |
| 4,326,204 | 4/1982 | Erin | 346/75 |
| 4,341,098 | 7/1982 | Otting | 68/205 |
| 4,356,217 | 10/1982 | Wollam | 427/280 X |
| 4,417,255 | 11/1983 | Furukawa . | |
| 4,523,202 | 6/1985 | Gamblin . | |
| 4,563,688 | 1/1986 | Braun . | |
| 4,575,730 | 3/1986 | Logan . | |
| 4,587,528 | 5/1986 | Beaudet . | |
| 4,596,990 | 6/1986 | Hou . | |
| 4,644,369 | 2/1987 | Gamblin | 346/75 |
| 4,698,642 | 10/1987 | Gamblin | 346/75 |

FOREIGN PATENT DOCUMENTS 2062787 12/1970 Fed. Rep. of Germany .

OTHER PUBLICATIONS

Darling et al., Multiple-Nozzle Ink Jet Printing Experiment, IBM. J. Res. Develop, vol. 28, No. 3, May 1984, pp. 300-306.

Meyer et al, "Ink Jet Printing—A new Possibility in Textile Printing", *Melliand Textiberichte,* English Ed., Feb. 1977, pp. 162-164; 255-261, (also attached is a German version of the article providing the drawings referred to in the article).

Oster et al, "Moire Patterns", *Scientific American,* May 1963, pp. 54-63.

*Primary Examiner*—Joseph W. Hartary

*Attorney, Agent, or Firm*—Nixon & Vanderhye

[57] ABSTRACT

The fluid jet applicator of the present invention utilizes a piezoelectric crystal to artificially stimulate the fluid supply chamber with coherent acoustic energy to pruposely generate and exploit the acoustic standing waves therein. As a result, although sized droplets will be formed at substantially the same frequency from each orifice, individual droplets will be formed so as to be out of phase with its adjacent neighbors in accordance with the standing acoustic wave pattern. By selecting only a very short print time, e.g., such that only one or two drops are formed within such a time and by controlling the frequency of such print time, a wide range of aesthetically appealing, unique, random interference of patterns can be created. Patterns closely simulating natural wood grains including knot holes can be readily produced by the present invention. More, the present invention allows patterns to be modified with relative ease and remarkable flexibility.

63 Claims, 13 Drawing Sheets

PRINTING RANDOM PATTERNS WITH FLUID JETS

RELATED APPLICATIONS

This is a continuation of application Ser. No. 026,488, filed Mar. 16, 1987, now abandoned which is a continuation-in-part of application Ser. No. 908,289, filed Sep. 17, 1986 which is a division of application Ser. No. 729,412, filed May 1, 1985 now U..S. Pat. No. 4,650,694.

FIELD OF THE INVENTION

The present invention relates to method and apparatus for generating random interference patterns printed upon a moving substrate. More particularly, the invention relates to controlling a fluid jet applicator to generate unique print patterns which simulate natural wood grains, watered silk, and other related non-repetitive patterns.

BACKGROUND AND SUMMARY OF THE INVENTION

Although having a generally similar "look" or overall appearance, a careful study of natural wood grain patterns or moire ("watered") silk patterns reveals that such patterns are essentially unique non-repetitive random patterns. Considerable effort has been directed to duplicating wood grains and other naturally varying patterns. For example, table tops which are created by laminated plastics (or other suitable processes) often include a sheet on which a pseudo wood grain has been printed.

The nature of such presently practiced processes is that the patterns produced, while attempting to appear to be natural, random patterns, are in fact repetitive. For example, "wood grain" patterns produced by conventional printing processes such as the roller press, rotogravure, letter press, etc., include large patterns formed by repeating smaller patterns. Thus, rather than being truly random, patterns produced by such devices are formed of readily discernible repetitive pattern lengths.

In addition, the printing devices which have heretofore generated such patterns have significant limitations. For example, rotogravure printing, when used for printing "wood grain" patterns on linoleum and other floor coverings, requires laborious preparation of extremely large diameter printing rolls. The printing press structure to support these rolls is massive. Moreover, to change the printing pattern in a rotogravure process requires that an entire new roll be engraved and inserted into the printing press.

The present invention provides apparatus for applying to a wide range of substrates random patterns, such as wood grains, that accurately simulate unique and non-repetitive patterns observed in nature. In addition, the present invention provides a highly flexible process for generating a wide range of such patterns.

As will be explained in detail below, the apparatus of the present invention may be readily controlled to change the spacing and the nature of random patterns being produced. Additionally, with the present invention, random patterns may be superimposed on other patterns, e.g., letters symbols, pictures, photographs, to create a wide range of aesthetically pleasing effects.

The patterns produced by the present invention may be broadly denoted as "random interference" patterns.

Such patterns may include wood grain, moire (watered silk, waterfall or other related patterns.

Interference patterns, which are generically referred to as "moire" patterns in a Scientific American article by Oster et al typically result from the superposition and resulting interference between two periodic sub-patterns (e.g., two angularly oriented gratings). Such interacting sub-patterns must have transparent regions if they are to be superimposed as in Oster et al, Scientific American, May, 1963 pages 54–63.

The "moire" silk pattern shown on page 54 of the Oster et al article results from the superposition of two sets of nearly parallel cords to produce a fabric having a shimmering appearance resembling the wavelike reflections on the surface of a pool of water. The interference pattern phenomena is such that a tiny displacement between two nearly aligned arrays of lines will be greatly magnified.

In the present invention, an electrostatic jet applicator is uniquely controlled to selectively create random interference patterns which simulate wood grain, "moire" silk and other related patterns. Initially the operation of the fluid jet applicator will be generally described followed by a detailed disclosure as to how the random interference patterns are generated.

The electrostatic fluid jet applicator of the present invention is designed to apply a fluid (e.g., a liquid dye) to a moving substrate (e.g., paneled wall ceiling material, fabric, etc.) by: (a) selectively charging and recovering some of the fluid droplets continuously ejected from a stationary linear array of orifices affixed transverse to movement of the substrate, while (b) allowing remaining selectively uncharged droplets to strike the substrate (e.g., thereby forming an image on the substrate).

More particularly, fluid is supplied to a linear array of liquid jet orifices in a single orifice array plate disposed to emit parallel liquid streams. These liquid jets break into corresponding parallel lines of droplets falling downwardly toward the surface of a substrate moving transverse to the linear orifice array. A droplet charging electrode is disposed so as to create an electrostatic charging zone in the area where droplets are formed (i.e., from the jet streams passing from the orifice plate). A downstream catching means generates an electrostatic deflection field which deflects all charged droplets into a catcher where they are typically collected, reprocessed and recycled to a fluid supply tank. In this arrangement, only those droplets which happen not to get charged are permitted to continue falling onto the surface of the substrate.

In prior art fluid jet applicators, great care is typically taken to produce droplets that are regularly and precisely spaced, sized, and timed across the orifice array in order to permit proper use of the apparatus. It is well recognized that such uniform droplet production is adversely affected by non-uniform stimulation across the orifice array due to reflected and interfering waves (i.e., so as to produce "standing" waves) such that certain orifices do not have the appropriate stimulation while others have too much.

In accordance with conventional wisdom, prior art fluid jet applicators have been designed to eliminate or reduce such standing wave patterns in order to achieve proper applicator operation. In such applicators, the orifice plates have been limited in length, employed dampening control and many other techniques to eliminate the problems caused by standing wave patterns.

The fluid jet applicator of the present invention utilizes a piezoelectric crystal to artificially stimulate the fluid supply chamber with coherent acoustic energy to purposely generate and exploit the acoustic standing waves therein. As a result, although substantially uniformly sized droplets will be formed at substantially the same frequency from each orifice, individual droplets will be formed so as to be out of phase with adjacent neighbors in accordance with the standing acoustic wave pattern. By selecting only a very short print time, e.g., such that only one or two drops are formed within such a print time and by controlling the frequency of such print time, a wide range of aesthetically appealing, unique, random interference patterns can be created and printed. Patterns closely simulating natural wood grains (including knot holes) can be readily produced by the present invention. Moreover, the present invention allows patterns to be modified with relative ease and remarkable flexibility.

DETAILED DESCRIPTION OF THE INVENTION

Before discussing the actual fluid jet apparatus of the present invention, it is worthwhile to first focus on the general technique by which fluid jet applicators may be controlled to produce random interference patterns. As noted above, if equal acoustic power is delivered to each orifice in an orifice array during normal operating conditions, an essentially straight print line in the cross-machine direction would be created by droplets striking the substrate.

In the present invention, the fluid plenum is stimulated so as to purposefully generate standing waves, a condition which prior art jet applicators have sought to avoid. The frequency and amplitude of stimulation is selected not only to set up standing waves within the fluid plenum, but also to cause fluid filaments to break up into equal sized regularly spaced (in the vertical direction) droplets. (Typically, the filaments are also regularly spaced along the orifice plate by virtue of the spacing of the orifices in the orifice plate, but this is not absolutely necessary.)

Figure 1:
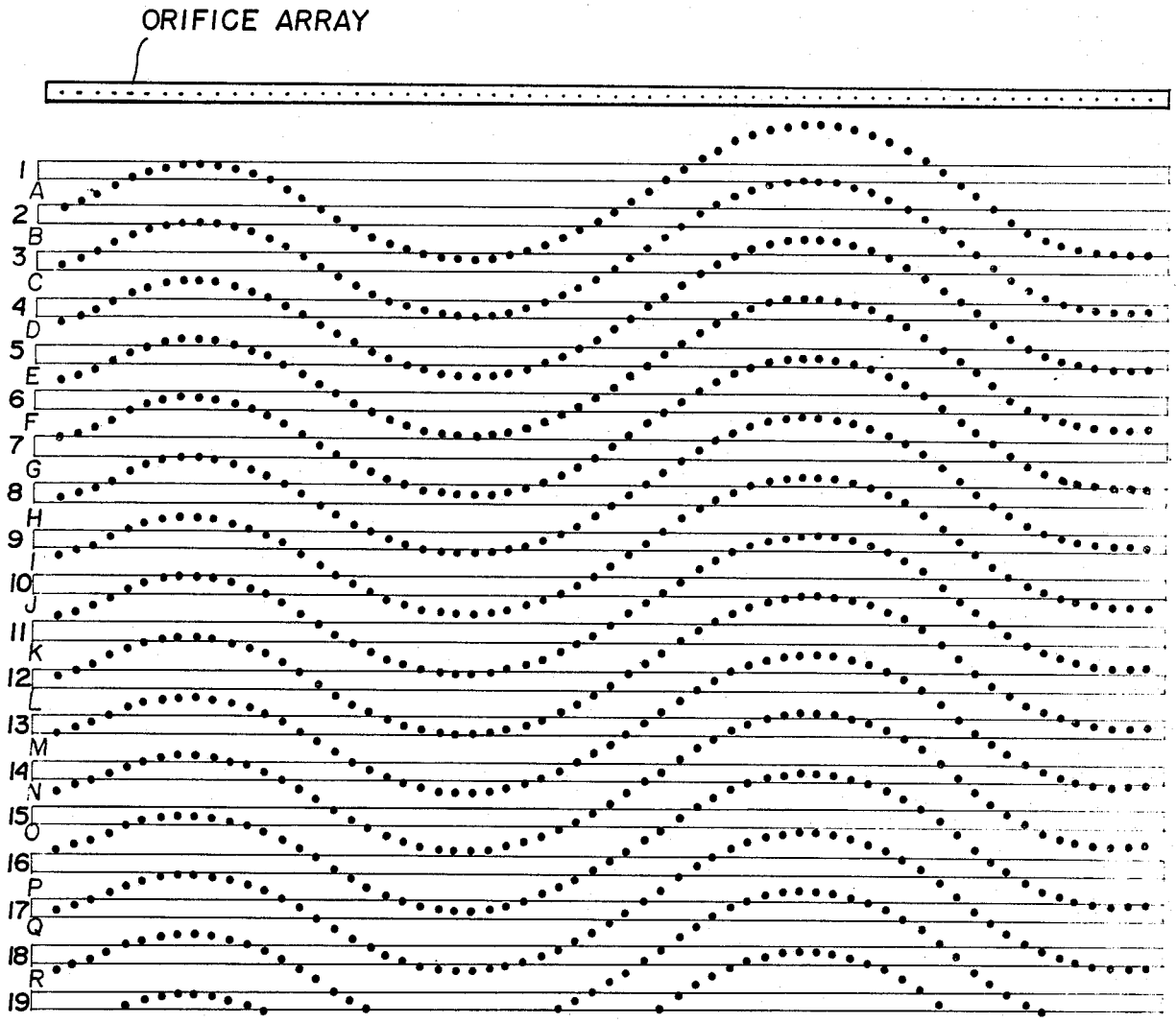
FIG. 1 is a schematic representation of curtain of droplets emanating from an orifice array under the influence of a standing wave pattern.

FIG. 1 is a schematic representation of a curtain of droplets emanating from an orifice array where standing waves have been set up within the fluid plenum. The frequency of stimulation is selected such that the filaments from each orifice break up into equal sized regularly spaced droplets (with respect to a droplet's vertically displaced neighbor) as is shown in FIG. 1. However, due to the presence of standing waves in the fluid plenum, in the cross-machine direction each droplet is not formed at precisely the same time as its left and right neighbors. As can be seen in FIG. 1, moving from left to right the droplet pattern of leading and lagging droplet formation times varies in a wave-like fashion. The wave pattern depicted in FIG. 1 is exemplary only. Many standing wave patterns can be produced. Moreover, the depiction of FIGS. 1–4 is theoretical only, to illustrate a concept of interference as applied in this invention.

The spacing between each droplet and its adjacent upper and lower neighbor can be described in terms of t, the period of the stimulation frequency applied to the fluid plenum. Thus, a droplet is formed and breaks off from each filament every t seconds, the droplet being out of phase with its right and left neighbors. If all the droplets emanating from the orifice array under the conditions shown in FIG. 1 were permitted to strike the substrate, (with the substrate moving at moderate speed) a solid shade would result.

By selectively controlling the on and off cycling of the charging voltage applied to the charging electrode(s), the applicator of the present invention can generate random interference patterns which simulate wood grain, watered (moire) silk and other related patterns. In order to generate a truly random interference pattern besides purposefully setting up standing waves, the present invention limits the print time period to a sufficiently small duration such that very few drops, usually two or less, are formed during the print time selected.

Figure 2:
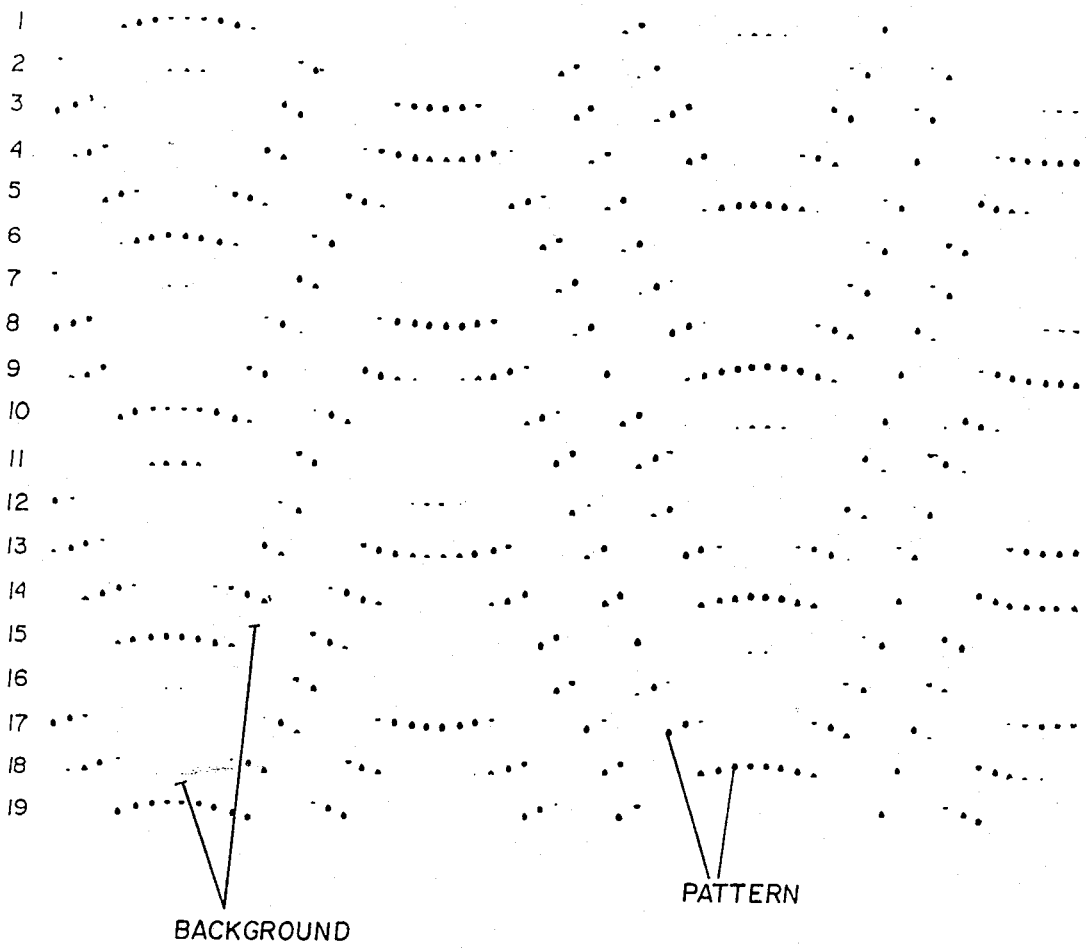
FIGS. 2–4 are schematic representations of the resulting random interference patterns appearing on non-wicking substrates resulting from three different print time ON/OFF duty cycles.

FIG. 2 schematically represents a random interference pattern which may be generated on a flat non-wicking substrate by exercising electrostatic control over the droplet curtain shown in FIG. 1. In this regard, if during the time intervals 1, 2 . . . 19 corresponding to the so-labelled bands in FIG. 1, no charging voltage is applied to the charge electrode (such as electrode 16 described below with respect to FIG. 5), no charge will be induced on the droplets which are then adjacent to the charge electrode. During these "print" times, such droplets will strike the moving substrate in the pattern shown in FIG. 2. By applying a charging voltage during time intervals A, B . . .R, the droplets adjacent the charge electrode(s) during these intervals will have a charge imparted on them that they will be deflected into the catcher.

As can be seen in FIG. 2, an undulating interference pattern is formed. (The data depicted in FIGS. 2, 3, and 4 would typically be of equal size.)The pattern has a greater thickness and amplitude, but similar cross-machine wave length to the standing wave pattern. It is the interaction (or interfrence) between standing wave pattern and the ON/OFF pattern of the print cycle which results in a random interference pattern which is printed onto a substrate which moves under the orifice array.

The pattern shown in FIG. 2 shows a dramatic accentuation of the cross-machine standing waving pattern. In practice, the interference pattern becomes more distinct as the print period is decreased. FIG. 2 schematically represents a fluid jet applicator set with a print time ON of 0.33t and a print time OFF or 0.5t, where t is the period of the stimulation frequency. It is noted that the near "negative" of FIG. 2 (i.e., the white portion of the FIG. 2 pattern will appear dark and the darker portion of the pattern will appear white), may be generated by utilizing a print time of 0.5t and a print time OFF of 0.33t (the reverse of FIG. 2 conditions).

As noted above, it is the interaction between the ON/OFF pattern of the print cycle and the standing wave pattern which produces a random interference pattern. Modifying the ON/OFF pattern of the print cycle, while maintaining the print ON time below a predetermined maximum print time will vary the resulting random interference patterns.

It also follows that by varying the standing wave pattern, the random interference patterns may likewise be varied. It is noted that varying standing wave patterns can be obtained by varying any of a number of parameters. These include the frequency of stimulation, the physical configuration of the print bar, the waveform of the stimulation frequency, the addition of harmonics to the stimulation frequency, variations of the bar pressure in the fluid plenum, the number of and spacing of the piezoelectric crystals 34 (see FIG. 5), the sizes of the orifices in the orifice plate, the viscosity of the print fluid, and the addition of other external vibration sources.

Figure 3:
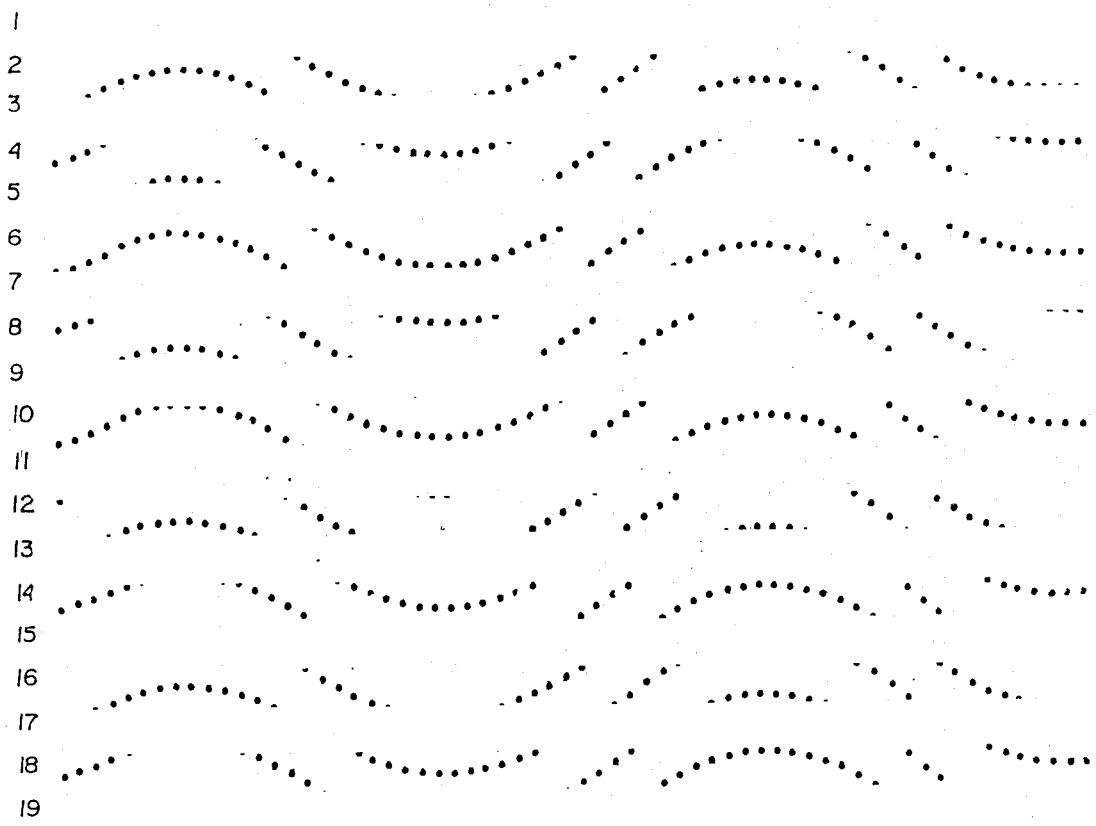

A variation in the visual effect obtainable with a given standing wave pattern can be seen in FIG. 3. Here, the print cycle is 0.83t ON and 0.83OFF. With such increased print time, the random interference pattern is much less apparent. As the print time is further increased, almost no random interference pattern can be perceived. Rather, the alternating on and off patterns predominate providing an overall relatively uniform distribution of marks. As the print time is gradually increased, the substrate appearance will begin to approach the print conditions disclosed in related application Ser. No. 908,289 to achieve a more uniform solid shade coverage.

Figure 4:
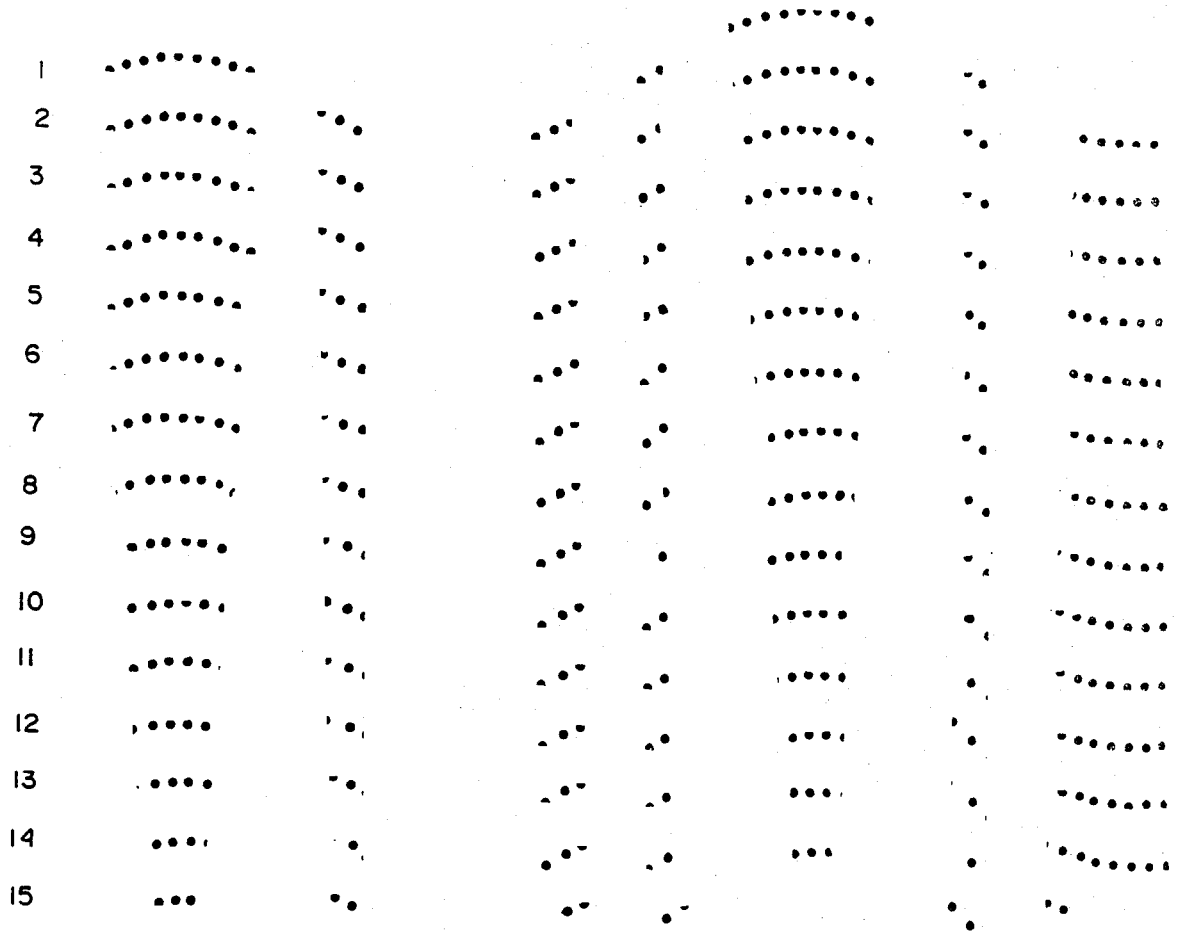

In FIG. 4, the print cycle is 0.33t on and 0.66t off. This results in the combined print on and off cycle being nearly equal to the period of the droplet formation. Therefore, in FIG. 4 the printed slices tend to repeat themselves, resulting in a far less random appearing pattern. There is, however, a very slight change in the pattern corresponding to a very slight difference between the print cycle period and the droplet formation period. The resulting pattern is a random interference pattern having very long machine direction striations. This pattern appears to stimulate cascading or falling water or a long grained wood grain.

As should be apparent from FIGS. 1-4, using the same standing wave pattern, significantly different random interference patterns may be generated by keeping the print ON time below a predetermined level and by using respectively corresponding different print ON and OFF times.

Turning back to FIG. 2, the random interference pattern shown therein includes patterns of dark undulations disposed on a white background. To produce this pattern, the print time selected is such that about one drop per orifice is formed for the dark pattern and no drops for the background. A variation of this effect may be produced by increasing the print time so that two drops appear in the pattern, and one drop appears in the background thereby producing a contrasting background that has an attractive slightly shaded appearance.

Although the details of the applicator will be described in conjunction with a "solid shade" applicator having one ganged electrode, those skilled in the art will recognize that a pattern generating applicator having an array of charging electrodes likewise may be controlled to generate random interference patterns using the present invention. Such a pattern generating applicator may be advantageously controlled to generate indicia with a superimposed random interference pattern. (As used herein indicia refers to letters, symbols, and other predetermined non-random patterns.) In this fashion, for example, a company's name may be attractively displayed on a simulated wood background (or as simulated wood on a uniform or other background).

Figure 5:
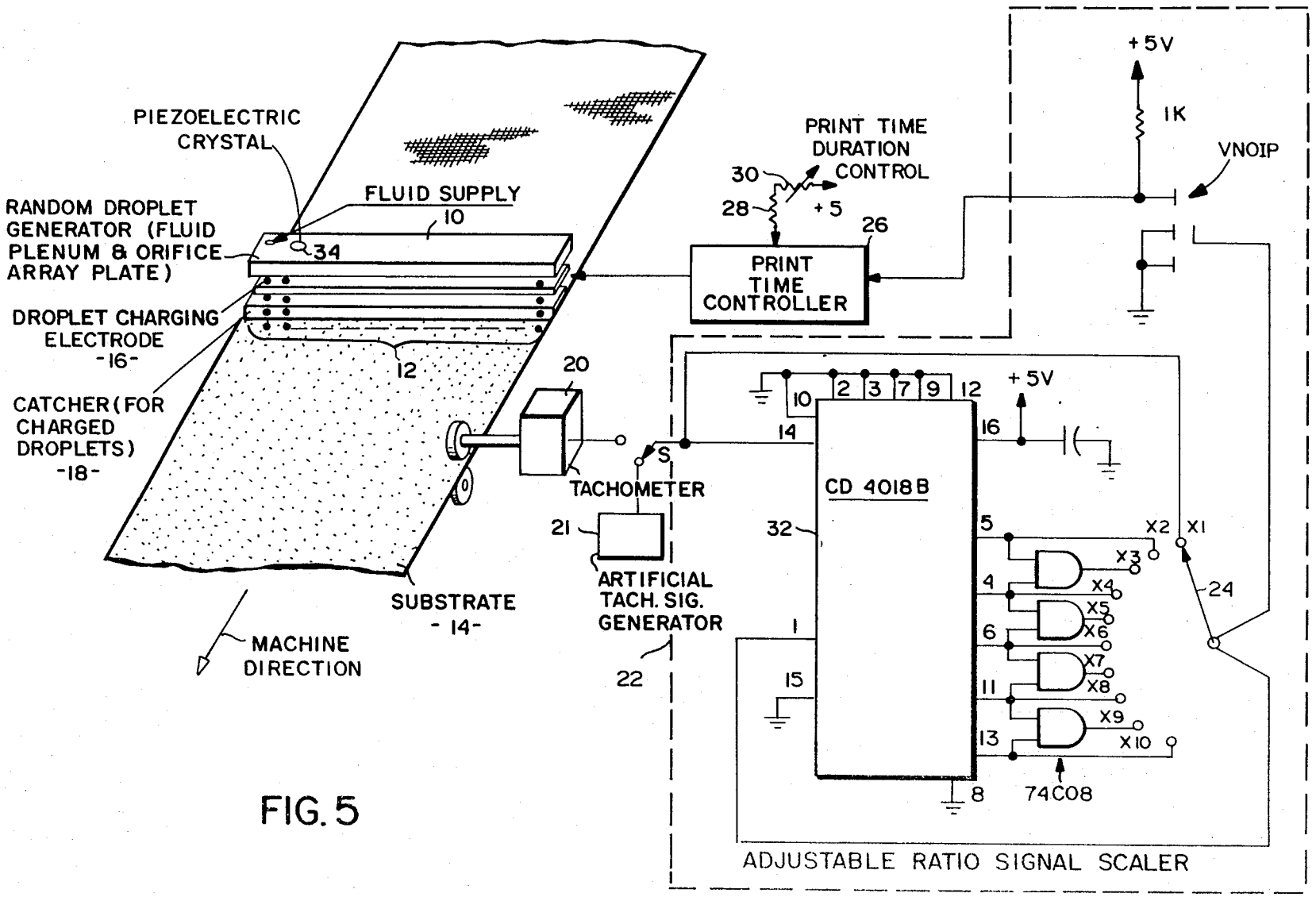
FIG. 5 is a schematic representation of an exemplary fluid jet applicator in accordance with the present invention.

An exemplary fluid jet electrostatic applicator for practicing the present invention to generate random interference patterns is depicted in FIG. 5. This applicator is a modified version of the solid shade applicator described in application Ser. No. 729,412, now U.S. Pat. No. 4,650,694 which application is hereby expressly incorporated by reference herein. As noted above, a fluid jet applicator having a separate charging electrode associated with each fluid jet orifice could alternatively be employed to generate such patterns using the control techniques described herein.

Turning to FIG. 5, the applicator includes a suitable pressurized fluid supply together with a fluid plenum which therein supplies a linear array of liquid jet orifices in a single orifice array plate (which may, for example, be the orifice plate disclosed in U.S. Pat. No. 4,528,070) disposed to emit parallel liquid streams or jets which break into corresponding parallel lines of droplets 12 falling downwardly toward the surface of a substrate 14 moving in the machine direction (as indicated by an arrow) transverse to the linear orifice array.

It is contemplated that random interference patterns may be applied to a wide range of substrates 14—even those which are flate (i.e., having a changing non-planar topography). For example, such patterns may be applied to paper, fabrics, doors, paneling flooring material, ceiling tiles, etc. As will be readily appreciated by those skilled in the art, the substrate transport must be designed to move these various sized substrates past the orifice plate in a position appropriate for printing.

A droplet charging electrode 16 is disposed so as to create an electrostatic charging zone in the area where droplets are formed (i.e., from the jet streams passing from the orifice plate). If the charging electrode 16 is energized, droplets then formed within the charging zone will become electrostatically charged. A downstream catching means 18 generates an electrostatic deflection field for deflecting such charged droplets into a catcher 18 where they are typically collected, reprocessed and recycled to the fluid supply. In this arrangement, only those droplets which happen not to get charged are permitted to continue falling onto the surface of substrate 14.

In contrast with the solid shade applicator disclosed in application Ser. No. 908,289, the random droplet generator in the applicator of the present invention is stimulated artificially by piezoelectric crystal 34. Although a single crystal is shown in FIG. 5, it should be recognized that for the purposes of the present invention, a plurality of crystals may be utilized to acoustically vibrate the fluid plenum. Indeed, the standing wave patterns set up in the plenum can be modified greatly by adding crystals and varying the signals to them.

In the present invention, the artificial stimulation produced by crystal 34 is designed to purposefully generate standing waves (even if they change with respect to time for generating the random interference patterns discussed above). Thus, the applicator need not include any mechanism for damping such standing waves.

The stimulation frequency is initially selected to make the filament lengths emanating from each orifice shorter and more uniform so that all the droplets will break off within the charge electrode region. Thus, although it is essential to generate standing waves to achieve random interference patterns, such standing waves are generated with the net acoustic power delivered at each orifice being such that the droplets will break off within the charge electrode region.

In order to meet these conditions, if the orifices in droplet generator 10 have a diameter of 0.003 inch, the fluid plenum may, for example, be stimulated by frequencies within the range of 10 KHz to 22 KHz. For an orifice plate having 0.002 inch diameter orifices, stimulation frequencies of approximately 25 to 35 KHz may be utilized.

The stimulation frequency determines how many drops per second will be generated. As indicated with respect to generating the random interference patterns discussed above in regard to FIGS. 2–4, a print time must be selected which will result in at least one drop, on average, being selected during the dark random interference pattern undulations with fewer drops in the white background.

For a 0.003 inch diameter orifice plate, which is stimulated at, for example, 10 KHz, a print time of 1/10 KHz or 100 μsec will result in one drop being formed per print pulse. Similarly, using 10 KHz stimulation, a print time of 200 μsec will result in two drops being generated (by a 0.003 inch diameter orifice) per print pulse. In order for the random interference pattern to be reasonably discernible, the print time must be small enough so that only one or two drops will be formed per print pulse.

Turning back briefly to FIG. 2, this pattern shows a generally dark undulating random interference pattern on a white background. This pattern may be produced with a 0.003 inch orifice jet being stimulated at 10 KHz with a 100 μsec print time whereby one drop defines the pattern and no drops define the background. If the print time were raised to 200 μsec, the random pattern area would receive two drops whereas the background would receive one drop. Thus, the contrast between the two areas would be reduced.

To achieve the necessary control and also achieve the desired degree of uniformity to treated substrate, the system of FIG. 5 provides an apparatus for adjusting the print time pulse duration and the center-to-center pixel spacing between occurrences of individual print time pulses along the longitudinal or machine direction of substrate motion. This design allows the apparatus to be useful for a relatively wider range of commercially desirable textile and other substrates. The adjustment of center-to-center pixel spacing in conjunction with proper control over the print time duration of each pixel site allows for the formation of a wide range of random interference patterns.

For solid shade applications, the embodiment of FIG. 5 show a tachometer 20 which is mechanically coupled to substrate motion. For example, one of the driven rollers of a transport device used to cause substrate motion (or merely a follower wheel or the like) may drive the tachometer 20. The tachometer 20 may comprise a Litton brand shaft encoder Model No. 74BII000-1 and may be driven by a 3.125 inch diameter tachometer wheel so as to produce one signal pulse at its output for every 0.010 inch of substrate motion in the longitudinal or machine direction. It will be appreciated that such signals will also occur at regular time intervals provided that the substrate velocity remains at a constant value. Accordingly, if a substrate is always moved at an approximately constant value, then a time driven clock or the like possibly may be substituted for the tachometer 20 as will be appreciated by those in the art.

In random interference pattern generating applications, switch S is set to disconnect tachometer 20 and to connect artificial tachometer signal generator 21. The artificial tachometer signal generator 21 is a signal generating device which provides a means to controllably vary the spacing between the undulating patterns shown in, for example, FIG. 2 to more closely simulate a wood grain pattern to be placed on paneling material, a door, ceiling tile, fabric, or other substrates. The signal generator 212 permits great flexibility in random interference pattern generation due to its ability to vary the frequency of signals transmitted to print time controller to controllably vary the frequency of the print pulses.

The artificial tachometer signal generator 21 breaks any correlation between substrate speed and print time frequency, i.e., the print time controller 26 is in effect informed that the substrate speed is other than its actual speed. The print time controller 26 responds to a signal generated by the artificial tachometer signal generator 21 by generating a print pulse of a predetermined fixed duration as will be discussed below.

The artificial tachometer signal generator 21 may simply be an oscillator whose output signals are by way of example only, TTL square wave pulses ranging in amplitude from +5 volts to OV, and whose frequency is controlled by the setting of a vernier control knob. In this embodiment, an operator may vary the random interference pattern by manually adjusting the oscillators frequency control knob. If the false tachometer signal generator 21 is set to generate a fixed frequency, a substantially fixed random interference pattern will result therefrom, e.g., a wood grain pattern.

By varying the frequency of the false tachometer signal generator 21 the random patterns may be varied. For example, if the frequency is varied in a cyclic manner, the resulting random pattern will closely simulate a wood grain pattern having closed knot holes therein. The knot hole effect results from the print cycle approaching being in phase with the stimulation frequency (resulting in a large interference pattern), then rapidly passing the in phase point to move rapidly away from the in phase point thereby resulting in a pattern resembling a closed knot hole. The frequency at which the knot hole effect will occur, i.e., the in phase point may be readily determined empirically.

In order to generate the knot hole effect, either the signal generator frequency control knob may be manually varied over a relatively narrow band of frequencies or a conventional sweep function generator, which changes frequency as a function of time can be utilized. In operation, the sweep function generator repetitively (e.g., once every 2 seconds) sweeps from a first preselected frequency to a second preselected frequency in a preselected period of time. In this manner, a repeating series of knot holes will be generated in the pattern.

A further technique for generating "false" tachometer signals is to connect in tandem the tachometer 20 with a special purpose frequency generator. Such a frequency generator processes the tachometer signals to produce other signals having a variable frequency to enable control over the interference patterns in the manner described above while also providing a degree of control over the required volume of fluid to be applied to the substrate in view of the substrate speed indicating signals.

In order to achieve random interference patterns, as an alternative to utilizing artificial tachometer signal generator 21, the substrate speed may be continuously varied above a minimum speed. The resulting tachometer signals will serve to generate random interference patterns albeit without the same flexibility in control as provided by the false tachometer signal generator 21.

In the solid shade applicator described in application serial number 908,289, an input signal from the tachometer 20 is applied directly to the adjustable ratio signal scaler 22 for each passage of a predetermined increment of substrate movement in the machine direction (e.g., for each 0.010 inch). The ratio between the number of applied input signals and the number of resulting output signals from the signal scaler 22 is adjustable (e.g., by virtue of switch 24).

When generating random interference patterns, signal scaler 22 receives the output signal from artificial tachometer signal generator 21. It is noted, however, that switch 24 is preferably set to position X1 when generating such patterns. When an output signal is produced by the signal scaler 22, then a conventional print time controller 26 generates a print time pulse for the charging electrode 16 (which actually turns the charging electrode "off" for the print time duration in the exemplary embodiment).

The print time controller 26 may, for example, be a monostable multivibrator with a controllable period by virtue of, for example, potentiometer 28, 30 which may constitute a form of print time duration control. For example, the fixed resistor 28 may provide a way to insure that there is always a minimum duration to each print time pulse while the variable resistor 30 may provide a means for varying the duration of the print time pulse at values above such a minimum, but below the maximum print time for random interference patterns to be formed as discussed above. As will be appreciated by those in the art, the generated print time pulses will be conventionally utilized to control high voltage charging electrode supply circuits so as to turn the charging electrode 16 "on" (during the intervals between print times) and "off" (during the print time interval when droplets are permitted to pass on toward the substrate 14).

In solid shade applications, for any given setting of switch 24, there is a fixed center-to-center pixel spacing. For example, if tachometer 20 is assumed to produce a signal each 0.010 inch of substrate movement, and if switch 24 is assumed to be in X1 position, then the center-to-center pixel spacing will also be 0.010 inch because the print time controllers 26 will be stimulated once each 0.010 inch. As explained above, with the utilization of artificial tachometer signal generator 21 this correlation does not exist when random interference patterns are generated.

The input to the signal scaler 22 also passes to a digital signal divide circuit 32 (e.g., an integrated COS/-MOS divided by "N" counter conventionally available under integrated circuit type No. CD4018B). The outputs from this divider 32 are used directly or indirectly (via AND gates as shown in FIG. 1) to provide input-/output signal occurrence ratios of 1:1 (when the switch is in the X1 position) to 10:1 (when the switch is in the X10 position) thus resulting in output signal rates from the scaler 22 at the rate of one pulse every 0.010 inch to one pulse every 0.100 inch and such an output pulse rate can be adjusted in 0.010 inch increments via switch 24 in this exemplary embodiment. The FET output buffer VNOIP merely provides electrical isolation between the signal scaler 22 and the print time controller 26 while passing along the appropriately timed stimulus signal pulse to the print time controller 26. Thus, the center-to-center spacing of pixels in the machine direction can be instantaneously adjusted by merely changing the position of switch 24. As will be appreciated by those in the art, there are may possible electrical circuits for achieving such independent but simultaneous control over center-to-center pixel spacing and the duration of print time intervals.

In a further embodiment of the present invention, print time controller 26 may, for example be implemented by a data entry keyboard, and microprocessor having an associated random access memory and programmable read-only memory (PROM). In this embodiment, each of a set of desired random interference patterns may be identified by a digital code. Stored in the PROM and associated with each of these patterns are empirically obtained applicator operating parameters known to produce the desired pattern. Upon keying in the pattern identifying code, the microprocessor now uses the identifying code to address the PROM to obtain, for example, a print time signal and control signals defining the necessary frequency for applying the print time Signal to obtain the identified pattern.

It must be emphasized that all that is contemplated by the microprocessor embodiment, is to conveniently control the applicator to produce patterns having a similar overall appearance. In view of the varying standing wave patterns and the random nature of the random interference patterns, it is unlikely the patterns may be exactly duplicated. This feature is highly desirable when printing fabrics for ladies dresses and the like.

Figure 6:
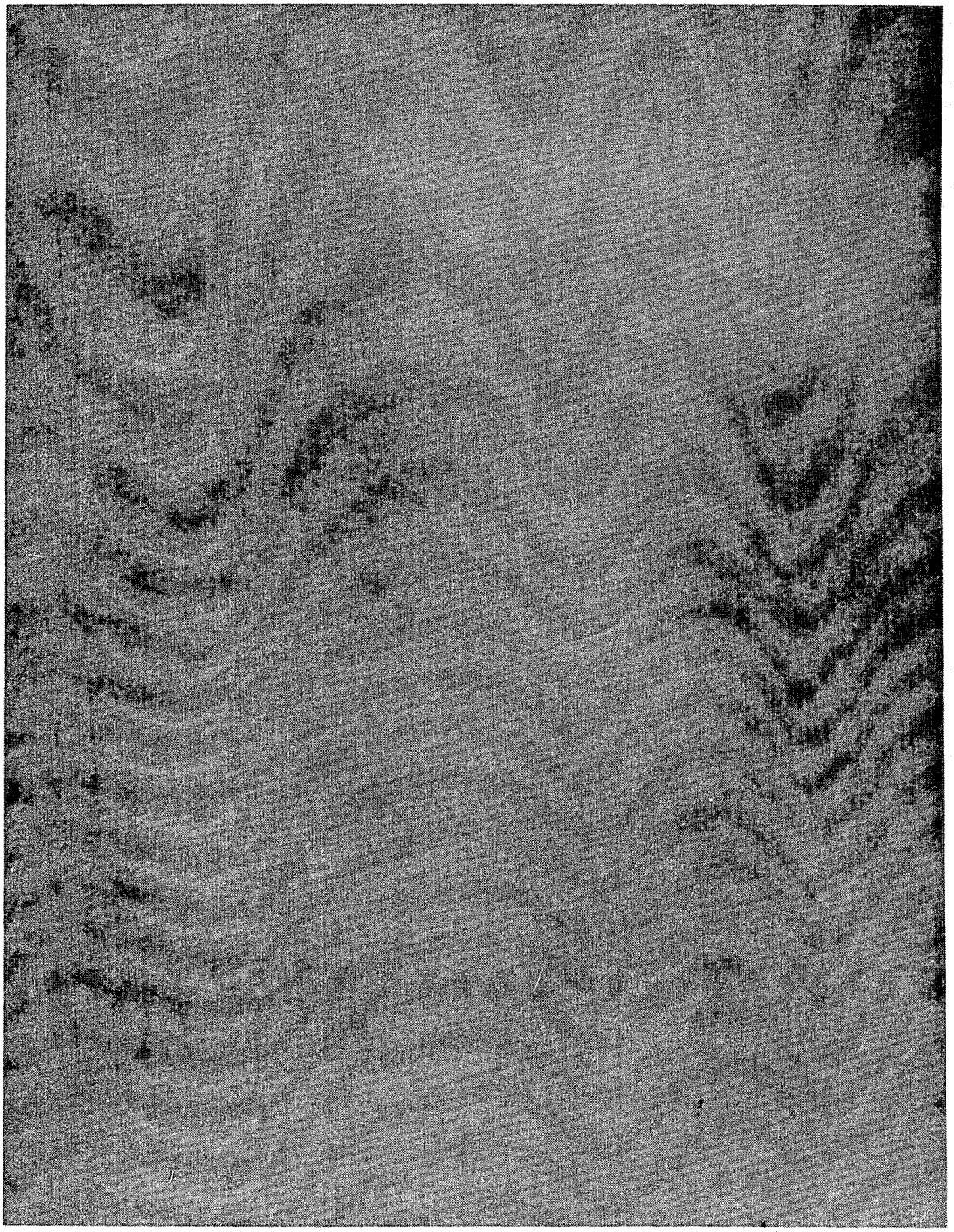
FIGS. 6–12 are photocopies of random interference pattern specimens printed in accordance with the present invention.
Figure 7:
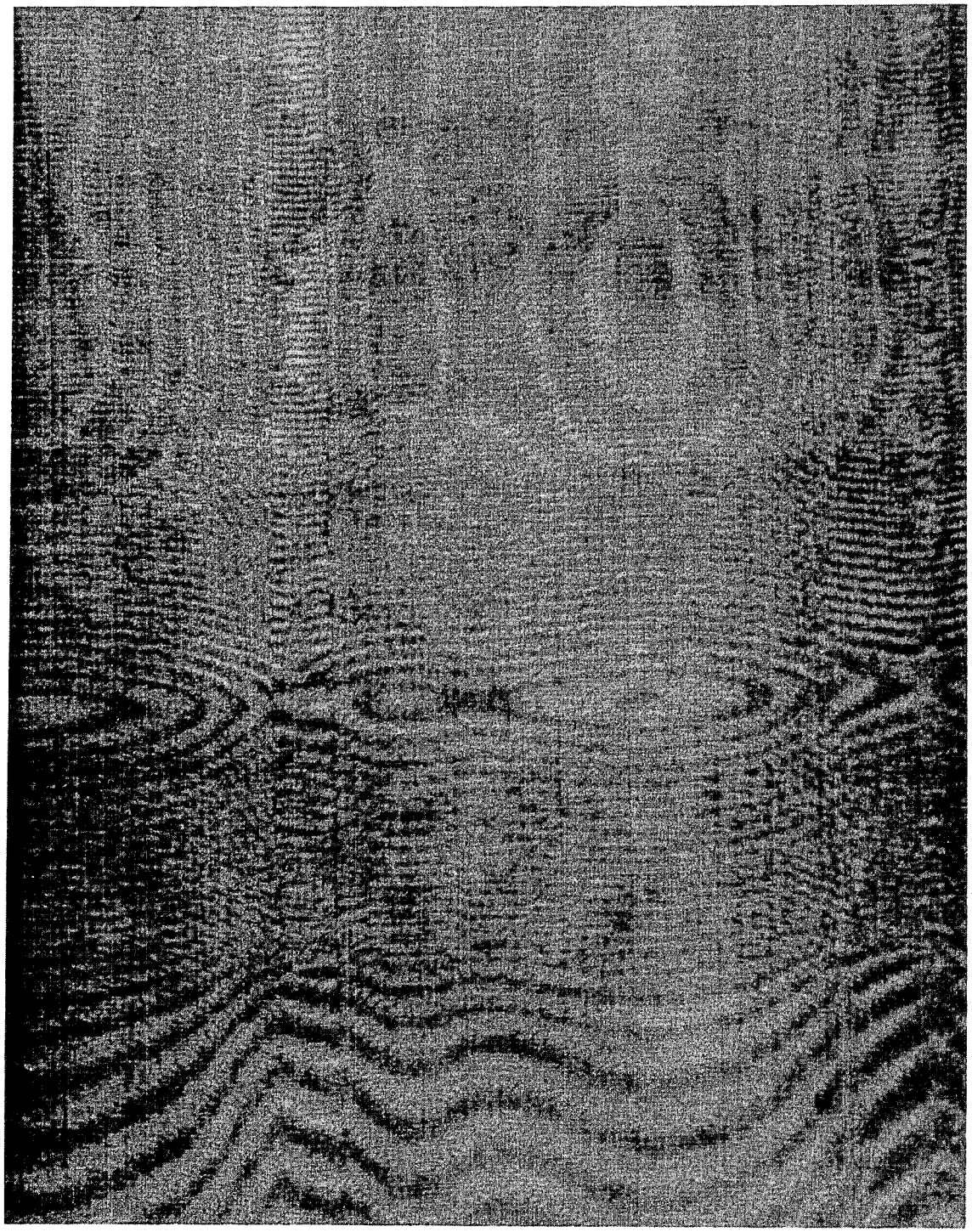

Turning next to some examples of actual patterns generated in accordance with the present invention, sample wood grain patterns are shown in FIGS. 6 and 7. As were all the sample patterns discussed herein, these wood grain patterns were generated using a 0.003 inch diameter orifice plate, with a print time of the order of 75 microseconds, and with a stimulation frequency on the order of 10–22 KHz. Both these samples were generated with a 20 inch orifice plate using two stimulation crystals in order to generate approximately uniform acoustic power across the orifice array.

The two crystals are connected in parallel and provide the same stimulation frequency with the same phasing. Two crystals are utilized primarily to avoid dead spots in the pattern although they do contribute to a different visual effect.

The large undulation which characterizes the wood grain effect is achieved by operation the artificial tachometer 21 such that the print cycle is close to being in phase with the stimulation frequency. FIG. 7 shows the knot hole effect while additionally demonstrating three different regions in which the pattern has been varied by changing the artificial tachometer frequency.

As indicated above, the patterns of the present invention are intended to be applied to a wide range of substrates. The substrate itself plays a significant roll in the visual effect ultimately achieved by the pattern.

Figure 8:
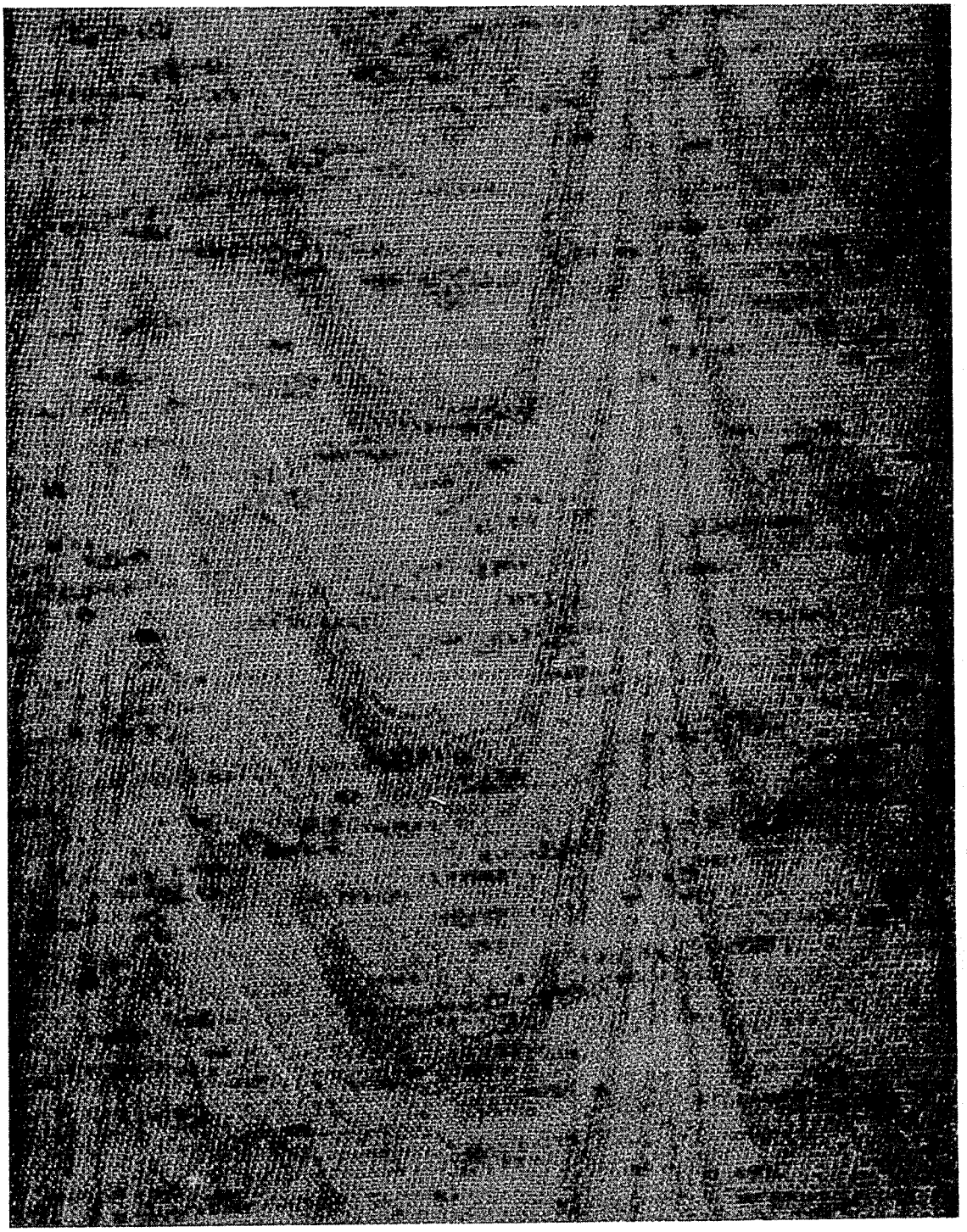

In this regard, the specimen shown in FIG. 8 is a foam-backed drapery fabric which appears to be of a twill weave with novelty slub yarns in the weft direction. As a result, the weave pattern plays a roll in the overall visual effect, and this weave pattern appearance is accentuated in the photocopy. The fabric was initially solidly dyed a mustard yellow color and the random interference pattern was applied as blue. The nubby portions of the weave pattern tend to pick up the green with the interstices showing more of the yellow. This accounts for the multiplicity of weft direction lines in the photocopy, since each weft picked up a certain amount of green, even in the lighter areas of the random interference pattern. This effect is accentuated in the weft slub yarn areas.

Figure 9:
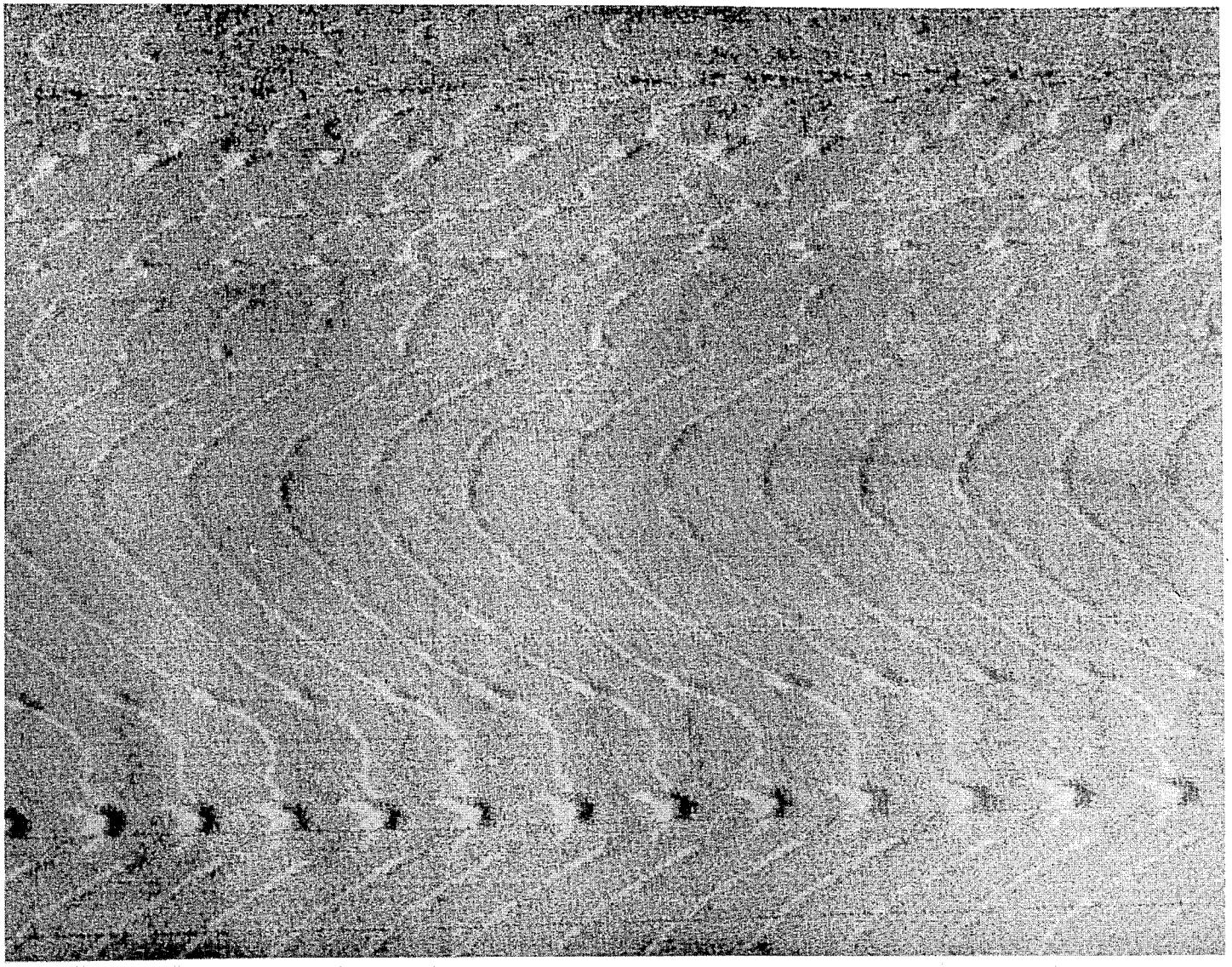
Figure 10:
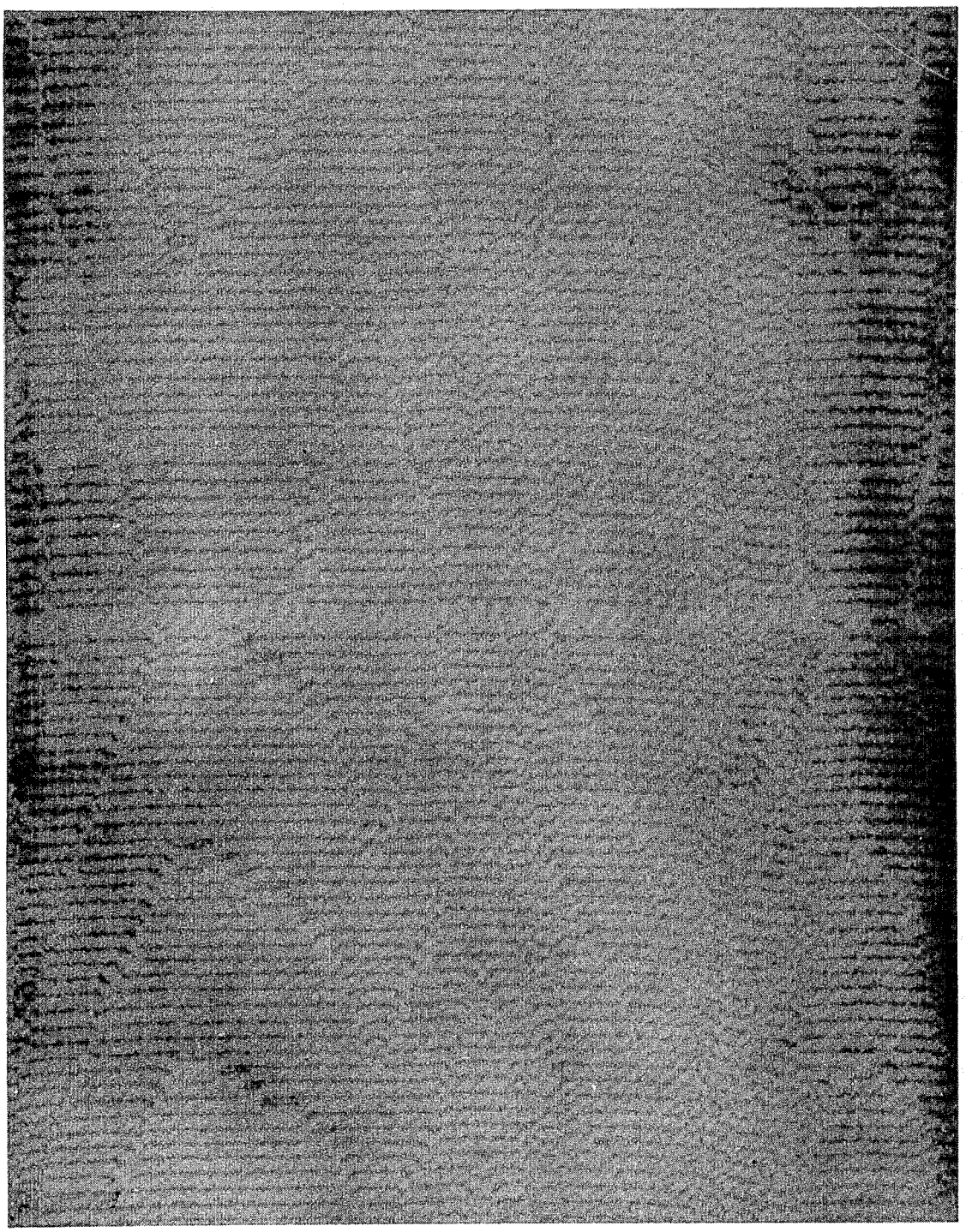
Figure 11:
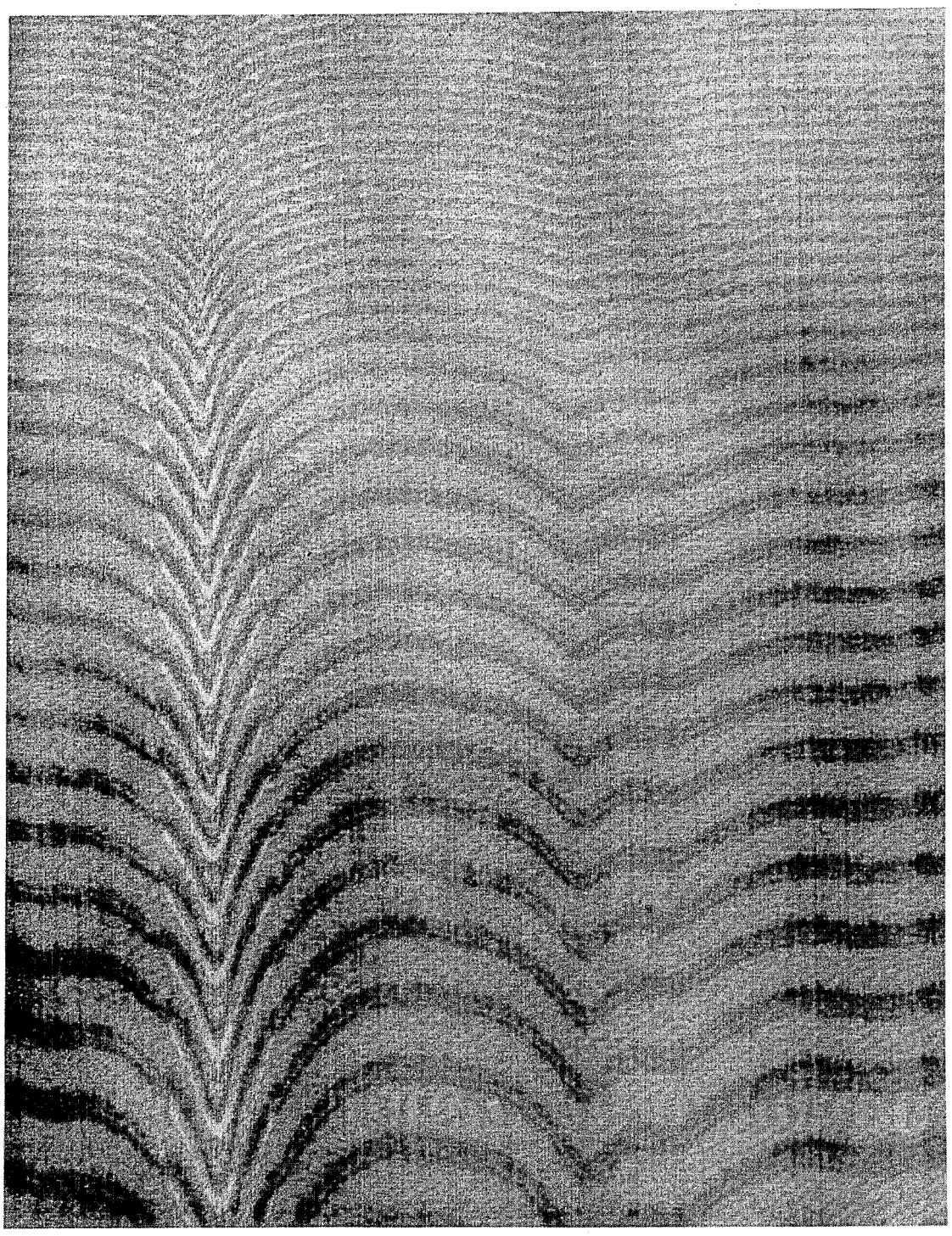

This sample shown in FIG. 9 is relatively lightweight and is a 65% polyester, 35% cotton fabric known as Burlington Industries "Bandmaster" brand. The print time was 75 microseconds during the application of the random interference pattern as noted on the pattern. In FIGS. 10 and 11, this same fabric specimen is shown with relatively broad spacing between print lines. FIG. 11 differs from FIG. 10 in that two crystals were used to generate the FIG. 11 pattern.

Figure 12:
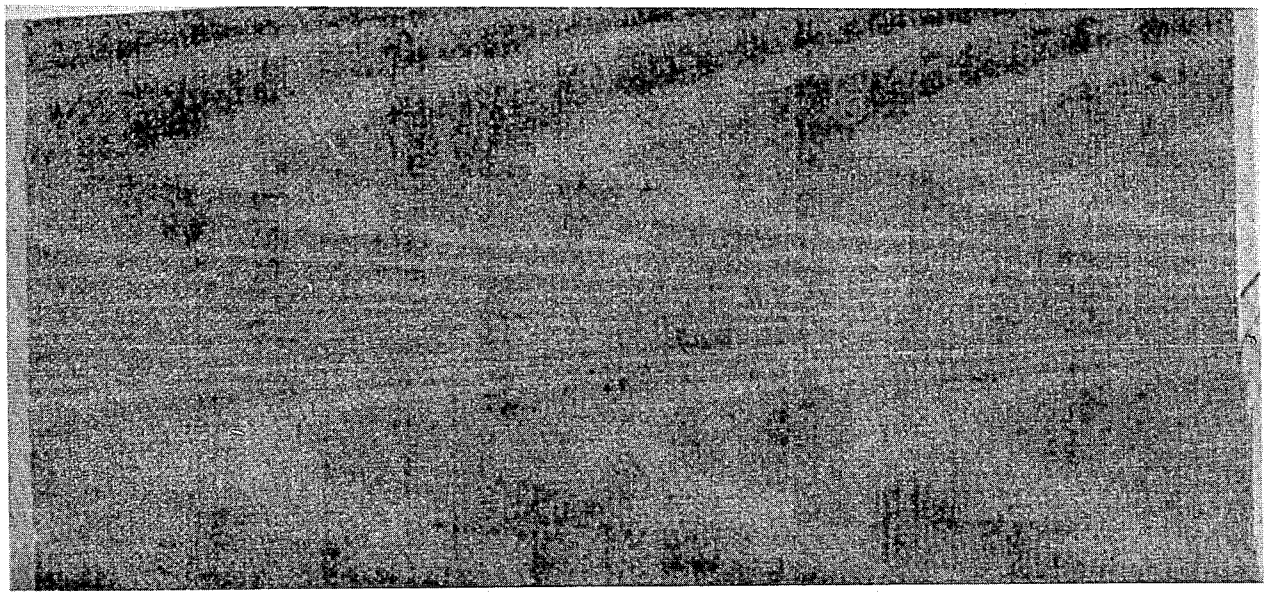

The specimen shown in FIG. 12 was done on basically the same fabric construction as the specimen of FIG. 8, but the fabric was undyed (no mustard yellow), with blue the applied color. The unprinted fabric can be seen on the lefthand edge of the fabric, with the random interference pattern covering the remainder.

Figure 13:
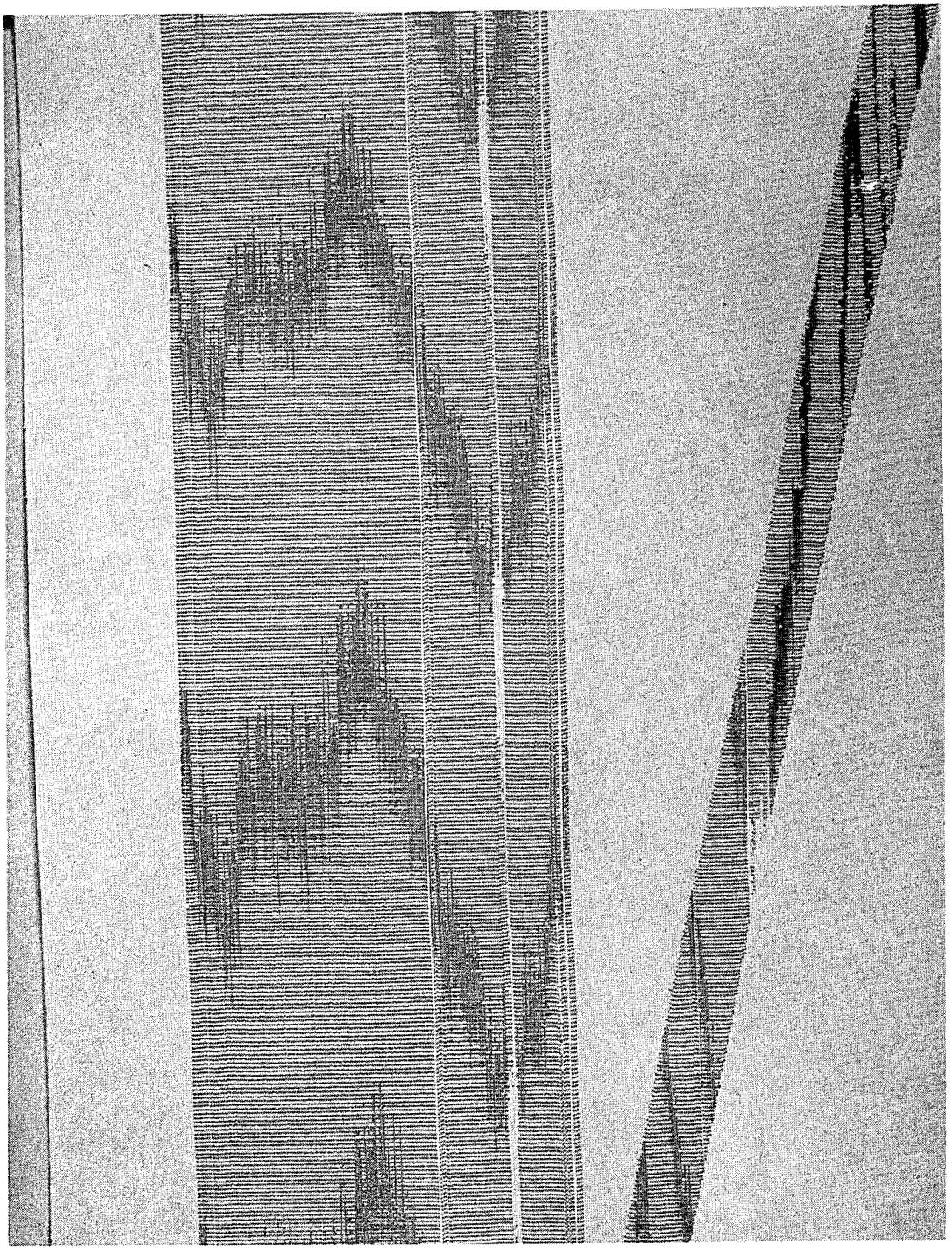

Finally, the specimen shown in FIG. 13 was printed on paper and illustrates that the random interference pattern can be superimposed on another pattern if the apparatus being used is a pattern generator (i.e., an apparatus having a multiplicity of cross-machine electrodes to provide cross-machine control), as opposed to an applicator in which only one cross-machine charge electrode is provided to control all of the orifices.

As should now be appreciated, this invention takes advantage of standing wave patterns in the fluid plenum to generate a wide range of random interference patterns. Since the inventor's recognition that standing wave patterns may be advantageously exploited, large cross-machine dimensions (e.g., 1.8 meters) may be employed which allow the applicator of the present invention to apply patterns to doors, paneling materials, standard width fabrics and the like. In addition, the particular patterns produced by the applicator of the present invention can be rapidly and readily varied by modifying operating parameters as discussed herein.

While only one presently preferred exemplary embodiment of this invention has been described in detail, those skilled in the art will recognize that many modifications and variations may be made in this exemplary embodiment while yet retaining many of the advantageous novel features and results. Accordingly, all such modifications and variations are intended to be included within the scope of the following claims.

I claim:

1. A method of applying random interference patterns to a moving substrate using a fluid jet applicator having a fluid plenum and an associated orifice array and means for selectively passing droplets onto the moving substrate only during controlled print times having a duration T, said method comprising the steps of:

applying artificial stimulation to said fluid plenum to purposefully generate standing waves within the fluid plenum to generate a droplet curtain such that a droplet emanating from a given orifice is not formed at the same time as droplets from neighboring orifices; and maintaining the print time T below a predetermined maximum value, said predetermined maximum value being selected so that a random interference pattern is applied by said selectively passing droplets of said droplet curtain onto said substrate, whereby said standing waves are purposefully utilized to generate said patterns and whereby a random interference pattern of a desired type may be applied to said substrate.

2. A method according to claim 1, wherein the step of maintaining the print time below a predetermined maximum value includes the step of selecting a print time such that no more than about one droplet per orifice is formed during such time.

3. A method according to claim 1, further including the step of selecting a print cycle which comprises a print time on interval followed by a print time off interval such that the random interference pattern appears colored without any background coloration.

4. A method according to claim 1, wherein the step of maintaining a print time below a predetermined maximum value includes the step of selecting a print time such that only about two droplets per orifice are formed during such time.

5. A method according to claim 1, further including the step of selecting a print cycle which comprises a print time on interval followed by a print time off interval such that the random interference pattern deeply colored on a background having relatively light coloration.

6. A method according to claim 1, further including the step of:

controlling the print cycle which comprises a print time on interval followed by a print time off interval to simulate a wood grain pattern.

7. A method according to claim 6, further including the step of:

controlling the frequency of the print time while maintaining the print time fixed below said predetermined maximum value to simulate a wood grain pattern.

8. A method according to claim 7, wherein said controlling the frequency step includes controllably varying the frequency of the print time to thereby simulate a knot hole.

9. A method according to claim 8, including the step of sweeping through a predetermined range of frequencies.

10. A method according to claim 1, wherein said fluid applicator includes an artificial tachometer signal generating means for generating signals having a selectable frequency of further including the steps of:

generating artificial tachometer signals; and generating print time signals at a frequency corresponding to the frequency of such artificial tachometer signals, whereby said random interference patterns may be varied by varying the frequency of said artificial tachometer signals.

11. A method according to claim 1, further including the step of:

controlling the print cycle which comprises a print time on interval followed by a print time off interval to simulate a moire silk pattern.

12. A method according to claim 1, further including the step of:

controlling the print cycle which comprises a print time on interval followed by a print time off interval to simulate a falling water pattern.

13. A method according to claim 12, wherein the controlling step includes the step of selecting a print time and a spacing time ST between print times to be approximately equal to the period of the stimulation frequency.

14. A method according to claim 1, wherein said fluid jet application includes means for generating images including indicia and further including the step of:

generating an image which includes indicia; and superimposing a random interference pattern over such indicia.

15. A method according to claim 1, further including the step of:

purposefully varying the standing wave pattern to modify the currently generated random interference pattern.

16. A method according to claim 1, further including the step of:

applying the random interference pattern to paneling material.

17. A method according to claim 1, further including the step of applying the random interference pattern to ceiling tile.

18. A method according to claim 1, further including the step of:

applying the random interference pattern to a door.

19. A method according to claim 1, wherein the step of applying artificial stimulation includes the step of controlling the frequency of the applied stimulation so that the generated standing wave pattern is such that the net acoustic power delivered at each orifice causes the droplet breakoff from each orifice to remain within the charge electrode region.

20. A method according to claim 1, further including the step of modifying the generated random interference pattern by varying the print cycle which comprises a print time on interval followed by a print time off interval while maintaining the print time below said predetermined maximum value.

21. A method according to claim 1, further including the step of modifying the random interference pattern by controllably varying the substrate speed.

22. A substrate having a random interference pattern on at least one surface thereof, said interference pattern being applied to the substrate as it is moving using a fluid jet applicator having: a fluid plenum and associated orifice array; and means for selectively passing droplets onto the moving substrate only during controlled print times having a duration T, said substrate pattern being formed by the method of:

applying artificial stimulation to said fluid plenum to purposefully generate standing waves within the fluid plenum to generate a droplet curtain such that a droplet emanating from a given orifice is not formed at the same time as droplets from neighboring orifices; and maintaining the print time T below a predetermined maximum value, said predetermined maximum value being selected so that a random interference pattern is applied by said selectively passing droplets of said droplet curtain onto said substrate, whereby said standing waves are purposefully utilized to generate said patterns, and whereby a random interference pattern of a desired type is applied to said substrate.

23. A substrate according to claim 22, wherein the step of maintaining a print time below a predetermined maximum value includes the step of selecting a print time such that only one droplet per orifice is formed during such time.

24. A substrate according to claim 22, further including the step of selecting a print cycle which comprises a print time on interval followed by a print time off interval such that the random interference pattern appears dark without any background coloration.

25. A substrate according to claim 22, further including the step of selecting a print cycle which comprises a print time on interval followed by a print time off interval such that the random interference pattern appears dark on a background having some light coloration.

26. A substrate according to claim 22, further including the step of:

controlling the print cycle which comprises a print time on interval followed by a print time off interval to simulate a wood grain pattern.

27. A substrate according to claim 22, further including the step of:

controlling the frequency of the print time while maintaining the print time fixed below said predetermined maximum value to simulate a wood grain pattern.

28. A substrate according to claim 27, wherein said controlling the frequency step includes controllably varying the frequency of the print time to simulate a knot hole.

29. A substrate according to claim 22, wherein said fluid application includes an artificial tachometer signal generating means for generating signals having a selectable frequency and further including the step of generating artificial signals; and further including the steps of:

generating artificial tachometer signals, and generating print time signals at a frequency in response corresponding to the frequency of such artificial tachometer signals whereby said random interference pattern may be varied by varying the frequency of said artificial tachometer signals.

30. A substrate according to claim 22, further including the step of:

controlling the print cycle which comprises a print time of interval followed by a print time off interval to simulate moire silk.

31. A substrate according to claim 22, further including the step of:

controlling the print cycle which comprising a print time on interval followed by a print time off interval to simulate a falling water pattern.

32. A substrate according to claim 31, wherein the controlling step includes the step of selecting a print time and a spacing time ST between print times to be approximately equal to the period of the stimulation frequency.

33. A substrate according to claim 22, further including the step of generating an image including indicia; and superimposing a random interference pattern over such indicia.

34. A substrate according to claim 22, further including the step of:

purposefully varying the standing wave pattern to modify the currently generated random interference pattern.

35. A substrate according to claim 22, wherein the substrate is paneling material.

36. A substrate according to claim 22, wherein the substrate is a ceiling tile.

37. A substrate according to claim 22, wherein the substrate is a door.

38. A substrate according to claim 22, wherein the substrate is a fabric.

39. A substrate according to claim 22, further including the step of modifying the generated random interference pattern by varying the print cycle which comprises a print time on interval followed by a print time off interval while maintaining the print time below said predetermined maximum vale.

40. A substrate according to claim 22, further including the step of modifying the random interference pattern by controllably varying the substrate speed.

41. A fluid jet applicator for applying random interference patterns to a moving substrate comprising:

a fluid plenum and an associated orifice array;

means for selectively passing droplets onto the moving substrate only during controlled print times having a duration T;

means for applying artificial stimulation to said fluid plenum to purposefully generate standing waves within the fluid plenum to generate a droplet curtain such that a droplet emanating from a given orifice is not formed at the same time as droplets from neighboring orifices; and maintaining the print time T below a predetermined maximum value, said predetermined maximum value being selected so that a random interference pattern is applied by said selectively passing droplets of said droplet curtain onto said substrate, whereby said standing waves are purposefully utilized to generate said patterns and whereby a random interference pattern of a desired type may be applied to said substrate.

42. A fluid jet applicator according to claim 41, wherein said means for maintaining the print time below a predetermined maximum value includes means for selecting a print time such that no more than one droplet per orifice is formed during such time.

43. A fluid jet applicator according to claim 41, further including means for selecting a print cycle which comprises a print time on interval followed by a print time off interval such that the random interference pattern appears dark without any background coloration.

44. A fluid jet applicator according to claim 41, wherein the means for maintaining a print time below a predetermined maximum value includes means for selecting a print time such that only two droplets per orifice are formed during such time.

45. A fluid jet applicator according to claim 41, further including means for selecting a print cycle which comprises a print time on interval followed by a print time off interval such that the random interference pattern appears dark on a background having some light coloration.

46. A fluid jet applicator according to claim 41, further including means for selecting a print cycle which comprises to a print time on interval followed by a print time off interval to simulate a wood grain pattern.

47. A fluid jet applicator according to claim 46, further including means for controlling the frequency of the print time while maintaining the print time below said predetermined maximum value to simulate a wood grain pattern.

48. A fluid jet applicator according to claim 47, wherein said means controlling the frequency includes means for controllably varying the frequency of the print time to thereby simulate a knot hole.

49. A fluid jet applicator according to claim 41, including means for sweeping through a predetermined range of frequencies.

50. A fluid jet applicator according to claim 41, wherein said fluid applicator further includes an artificial tachometer signal generating means for generating signal having a selectable frequency and means for generating print time signals at a frequency corresponding to the frequency of said artificial tachometer signals whereby said random interference patterns may be varied by varying the frequency of said artificial tachometer signals.

51. A fluid jet applicator according to claim 41, further including means for selecting a print cycle which comprises a print time of interval followed by a print time off interval to simulate a moire silk pattern.

52. A fluid jet applicator according to claim 41, further including means for selecting a print cycle which comprises a print time on interval followed by a print time off interval to simulate a falling water pattern.

53. A fluid jet applicator according to claim 52, wherein said means for controlling includes means for selecting a print time and a spacing time ST between print times to be approximately equal to the period of stimulation frequency.

54. A fluid jet applicator according to claim 41, wherein said fluid jet applicator further includes means for generating images including indicia and means for superimposing a random interference pattern over such an image.

55. A fluid jet applicator according to claim 41, further including the step of:

means for purposefully varying the standing wave pattern to modify the currently generated random interference pattern.

56. A fluid jet applicator according to claim 41, further including means for applying the random interference pattern to paneling material.

57. A fluid jet applicator according to claim 41, further including means for applying the random interference pattern to ceiling tile.

58. A fluid jet applicator according to claim 41, further including the step of:

means for applying the random interference pattern to a door.

59. A fluid jet applicator according to claim 41, wherein said means for applying artificial stimulation includes means for controlling the frequency of the applied stimulation so that the generated standing wave pattern is such that the net acoustic power delivered at each orifice causes the droplet breakoff to remain within the charge electrode region.

60. A fluid jet applicator according to claim 41, further including means for modifying the generated random interference pattern by varying the print cycle which comprises a print time on interval followed by a print time off interval while maintaining the print time below said predetermined maximum value.

61. A fluid jet applicator according to claim 41, further including means for modifying the random interference pattern by controllably varying the substrate speed.

62. A method of operating a fluid jet applicator having a fluid plenum and an array of orifices, and means for applying fluid from said fluid plenum through said orifices to a moving substrate, said applying means including means for selectively passing droplets onto the moving substrate only during print times having a duration T, said method comprising the steps of:

controlling the fluid jet applicator to apply a simulated wood grain pattern to said substrate including applying artificial stimulation to said fluid plenum to purposefully generate standing waves within the fluid plenum; and maintaining the print time T below a predetermined maximum value, whereby a wood grain pattern is applied to said substrate.

63. A method of operating a fluid jet applicator having a fluid plenum and an array of orifices, and means for applying fluid from said fluid plenum through said orifices to a moving substrate, said applying means including means for selectively passing droplets onto the moving substrate only during print times having a duration T, said method comprising the steps of:

controlling the fluid jet applicator to apply a simulated moire silk pattern to said substrate including applying artificial stimulation to said fluid plenum to purposefully generate standing waves within the fluid plenum; and maintaining the print time T below a predetermined maximum value, whereby a moire silk pattern is applied to said substrate.

* * * * *